US005740960A

United States Patent [19]

Hammett

[11] Patent Number: 5,740,960

[45] Date of Patent: Apr. 21, 1998

[54] METHOD AND APPARATUS FOR HANDLING RAILCAR BRAKE SHOES

[76] Inventor: Eddie Gene Hammett, 324 E. 5th St., Newton, Kans. 67114

[21] Appl. No.: 670,331

[22] Filed: Jun. 25, 1996

Related U.S. Application Data

[63] Continuation of Ser. No. 359,275, Dec. 16, 1994, Pat. No. 5,531,379.

[51] Int. Cl.[6] ..... E01B 26/00

[52] U.S. Cl. ..... 238/1; 220/607

[58] Field of Search ..... 238/1, 2; 211/607, 211/909, 908, 913, 571, 890, 23.2, 23.83, 523

[56] References Cited

U.S. PATENT DOCUMENTS

| | | | |
|---|---|---|---|
| 3,727,791 | 4/1973 | Fraser et al. | 220/607 |
| 3,794,208 | 2/1974 | Roush et al. | 220/607 |
| 4,232,823 | 11/1980 | Eggermann | 238/2 |
| 4,932,532 | 6/1990 | Apps et al. | 220/607 |
| 5,531,379 | 7/1996 | Hammett | 238/1 |

*Primary Examiner*—Mark T. Le
*Attorney, Agent, or Firm*—John W. Carpenter; Carr, DeFilippo & Ferrell LLP

[57] ABSTRACT

A method and apparatus for handling new and used railway car brake shoes is provided. The apparatus comprises a rack assembly, having an end wall interconnected between a pair of side walls and a grid member perimetrically secured to bottom edges of the side walls and end wall, which has the ends of the side walls abutted against one side of a rail of a railroad track and is secured to at least railroad tie of the railroad track. The method comprises storing new brake shoes in a plurality of the racks along the tracks, removing new shoes as needed to replace used shoes of railway cars, and replacing the used shoes in the racks.

9 Claims, 4 Drawing Sheets

METHOD AND APPARATUS FOR HANDLING RAILCAR BRAKE SHOES

This is a continuation application of application Ser. No. 08/359,275, filed Dec. 16, 1994, now U.S. Pat. No. 5,531,379.

FIELD OF THE INVENTION

The present invention is related to brake shoes for railcars and a method of handling. More specifically, the present invention relates to an apparatus and method for retaining and storing new and used railcar brake shoes.

DESCRIPTION OF THE PRIOR ART

Railway cars, such as boxcars and the like, require frequent replacement of braking shoes. In railway yards, it is common practice to perform this procedure by collecting new brake shoes which have been haphazardly distributed in the general vicinity of the tracks, such as between opposed rails comprising a track or on outer sides of the rails of the track, replacing the old, worn shoes with the new ones, and discarding the old shoes on the ground near the tracks, such as between the rails of the tracks, or on outer sides of the rails of the tracks. With an annual quantity of replacement shoes in a typical size railway yard exceeding 10,000 brake shoes, it can be seen that a great number of shoes can wind up scattered around the railway yard to create a rather unsafe working environment where injuries (such as sprained ankles, bruises, broken legs or arms, broken knees or ankles, etc.) are likely to be suffered by railway workers and result in costs to railway companies at an average minimum of about $20,000 per injury occurrence. Thus, it can also be readily seen that what is needed and what has been provided by me is a simple apparatus and method for storing replacement and used brake shoes of trains near railway yards and/or tracks.

A patentability search was conducted and the following U.S. Patents were found: U.S. Pat. No. 2,821,307 to Linsely titled HOLDER FOR FUSES AND OTHER ARTICLES; and U.S. Pat. No. 5,316,143 to Horn titled DEVICE FOR HOLDING CYLINDRICAL SOCKET HEADS.

None of the foregoing U.S. Patents teach or suggest the instant invention.

SUMMARY OF THE INVENTION

The present invention achieves its desired objects by providing an apparatus for holding or retaining railcar brake shoes comprising a rack assembly having an end wall member secured to a first side wall member and a second side wall member, forming a structure that is generally U-shaped or generally C-shaped. A bottom edge is defined by the first side wall, the second side wall, and the end wall to which is secured a screen or a grid. The rack assembly is secured to at least one railroad tie, preferably a plurality of railroad ties.

The present invention further accomplishes its desired objects by providing a method for handling used and replacement brake shoes which are respectively removed and fitted to a railway car. The method comprises the steps of:

(a) providing a plurality of new brake shoes for being fitted to at least one railway car on a railway track supported by a railroad tie;

(b) providing a rack assembly having an end wall member secured to a first side wall member and a second side wall member, forming a structure that is generally U-shaped or generally C-shaped, and having a grid member secured to the first side wall member, the second side wall member, and the end wall member;

(c) securing the rack assembly to at least one railroad tie;

(d) disposing the plurality of new brake shoes in the rack assembly;

(e) removing old, worn brake shoes from the railway car;

(f) removing the new brake shoes from the rack assembly;

(g) fitting the new brake shoes on the railway car; and (h) disposing the old, worn brake shoes in the rack assembly.

The method further comprises disposing a plurality of rack assemblies along a railroad track on alternating opposed sides at intervals of about 150 feet.

The present method further provides a method for handling used brake shoes which are removed from a railway car on a railroad track comprising the steps of:

(a) providing a rack assembly comprising an end wall member secured to a first side wall member and secured to a second side wall member;

(b) securing the rack assembly to at least one of a plurality of railroad tie members supporting a pair of rail members such that the end wall member is generally parallel to one of the pair of rail members; and (c) removing at least one worn brake shoe from a railway car;

(d) disposing the at least one worn brake shoe in the rack assembly such that the worn brake shoe is contained within the first side wall, the second side wall, the end wall, and the one of the pair of rail members.

The present method also provides a method for handling new railway car brake shoes comprising the steps of:

(a) providing a plurality of new railway car brake shoes;

(b) providing a railroad track having a pair of rail members secured to a plurality of railroad tie members;

(c) providing a rack assembly comprising an end wall member secured to a first side wall member and secured to a second side wall member;

(d) securing the rack assembly to at least one of the plurality of railroad tie members such that the end wall member is generally parallel to one of the pair of rail members;

(e) disposing the plurality of new railway car brake shoes in the rack assembly such that the new railway car brake shoes are contained by the first side wall member, the second side wall member, the end wall member, and the one of the pair of rail members.

The present method also provides a method for preventing accidents in railway yards caused by accidental contact with stray railcar brake shoes comprising the steps of:

(a) providing a railway yard having a railroad track comprising a pair of rail members secured to a plurality of railroad tie members;

(b) providing a rack assembly comprising an end wall member secured to a first side wall member and secured to a second side wall member;

(c) securing the rack assembly to at least one of the plurality of railroad tie members such that the end wall member is generally parallel to one of the pair of rail members; and (d) disposing the stray railcar brake shoes in the rack assembly such that the stray railcar brake shoes are contained by the first side wall member, the second side wall member, the end wall member, and the one of the pair of rail members.

The present method also provides a rack assembly for retaining railcar brake shoes comprising an end wall secured to a first side wall and secured to a second side wall. The end wall and the first side wall and the second side wall are being supported by at least one of a plurality of railroad ties which support securedly a pair of rail members such that the end wall member is generally parallel to one of the pair of rail members.

These, together with the various ancillary objects and features which will become apparent to those skilled in the art as the following description proceeds, are attained by this novel apparatus and method, preferred embodiments thereof shown with reference to the accompanying drawings, by way of example only, wherein:

DETAILED DESCRIPTION OF THE INVENTION

Figure 1:
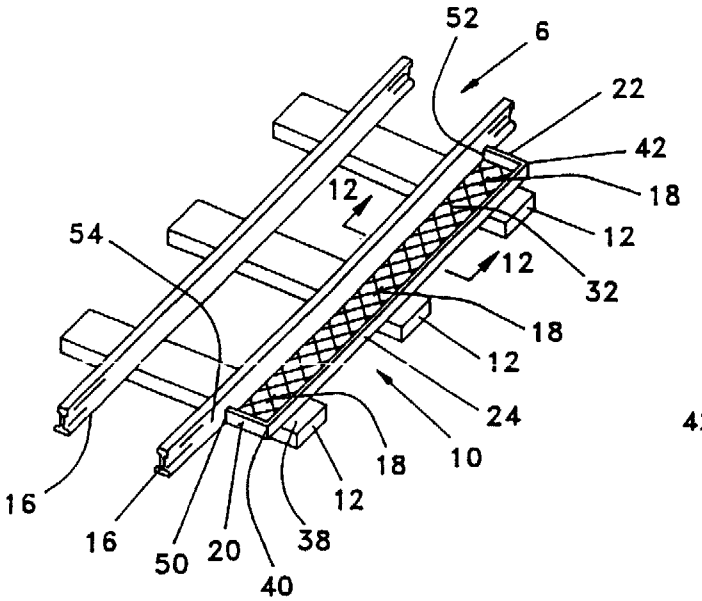
FIG. 1 is a perspective view of one embodiment of the rack assembly of the invention having the ends of two respective side walls abutted against a longitudinal side of a railroad track rail, and being secured to at least one (preferably three) railroad ties.

Turning now to the drawings wherein similar parts of the invention are identified by like reference numbers, there is seen the rack assembly of the invention, generally illustrated as 10 in FIG. 1. The rack assembly 10 is generally secured to or coupled to at least one railroad tie member 12 although preferably the rack assembly 10 is secured to at least two railroad tie members 12; more preferably the rack assembly 10 is secured to three railroad tie members 12.

Figure 2:
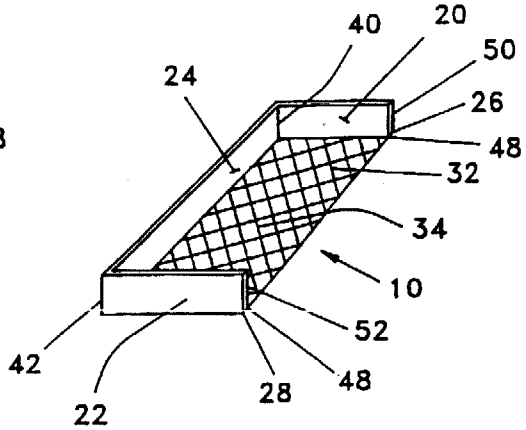
FIG. 2 is a perspective view of the rack assembly apart from the railroad track.
Figure 3:
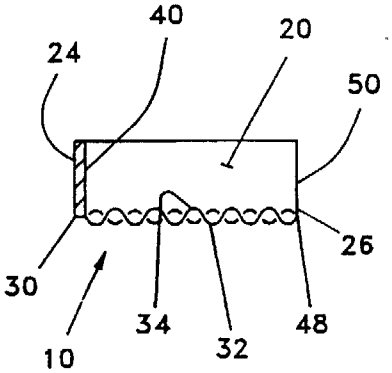
FIG. 3 is a cross-sectional view of the rack assembly.
Figure 7:
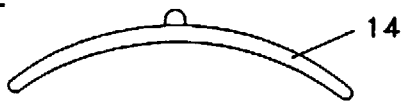
FIG. 7 is a side elevational view of a railcar brake shoe.
Figure 4:
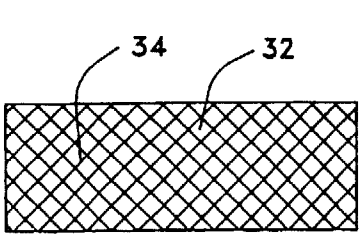
FIG. 4 is a top plan view of a mesh or grid member removed from the rack assembly.
Figure 5:
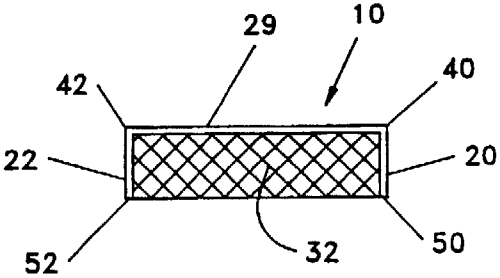
FIG. 5 is a top plan view of the rack assembly.
Figure 6:
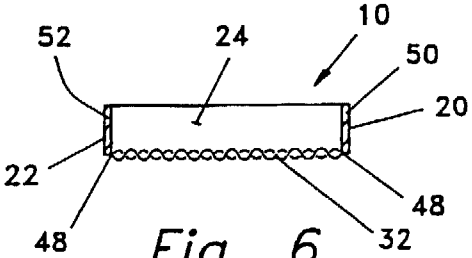
FIG. 6 is a front elevational view of the rack assembly.

The rack assembly comprises, as best shown in FIGS. 2 and 3, a side wall member 20 having one end 40 secured to or bound to one end 44 of an end wall member 24. Another side wall member 22 has one end 42 secured to or bound to another end 46 of the end wall member 24, such that the combination of the side wall 20, the end wall 24 and the end wall 22 define a generally U-shaped structure. Each wall member 20-22-24 has a respective bottom edge 26-28-30 thereof which in combination define a perimetrical lip or edge 48 for securing to a mesh or grid member 32, which, as shown in FIG. 4, may comprise any suitable steel mesh or grid suitable for supporting a plurality of brake shoe members (not shown in FIG. 4). The grid or mesh (screen-like) member 32 is perimetrically secured to the respective bottom edges 26-28-30 of the corresponding side wall 20, the end wall 24, and the side wall 22. The grid or mesh member 32 has a plurality of openings such that water, dirt, etc, may drain and/or pass therethrough.

The side walls 20-22 and the end wall 24 are all generally perpendicular to a common plane (i.e. the grid member Additionally, a longitudinal side (identified as 54 below) of a rail member (identified as 16 below) is generally perpendicular to the grid member 32 and generally parallel to the end wall 24. In one preferred embodiment, as will be further discussed in the following, the end wall member 24 measures from about 88 inches to about 92 inches in length, more preferably from about 89 inches to about 91 inches in length, most preferably about 90 inches in length. Each end wall 20-22 preferably measures from about 4 inches to about 8 inches in length, more preferably from about 5 inches to about 7 inches in length, most preferably about 6 inches in length. The grid member 32 accordingly is rectangular in shape and has short sides that are generally equivalent in length to the side walls 20-22 and long sides that are generally equivalent in length to the end wall 24. In this embodiment, the height of the end wall 24 and the side walls 20-22 is about 2 inches. In another embodiment, also to be discussed in the following, the end wall 24 is generally half as long (i.e., about 45 inches) as in the foregoing embodiment, and the side walls 20-22 are twice as long (i.e., about 12 inches) as in the foregoing embodiment.

Figure 9:
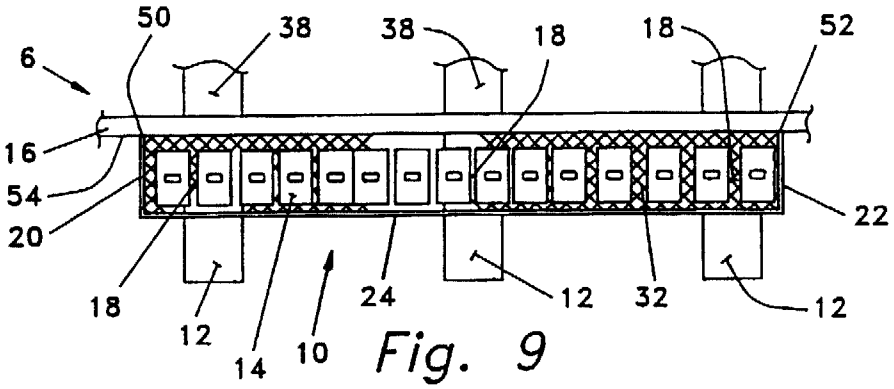
FIG. 9 is a top plan view of the embodiment of the rack assembly of FIG. 1 in combination with the railroad track having new and used brake shoes contained thereby in one row.
Figure 12:
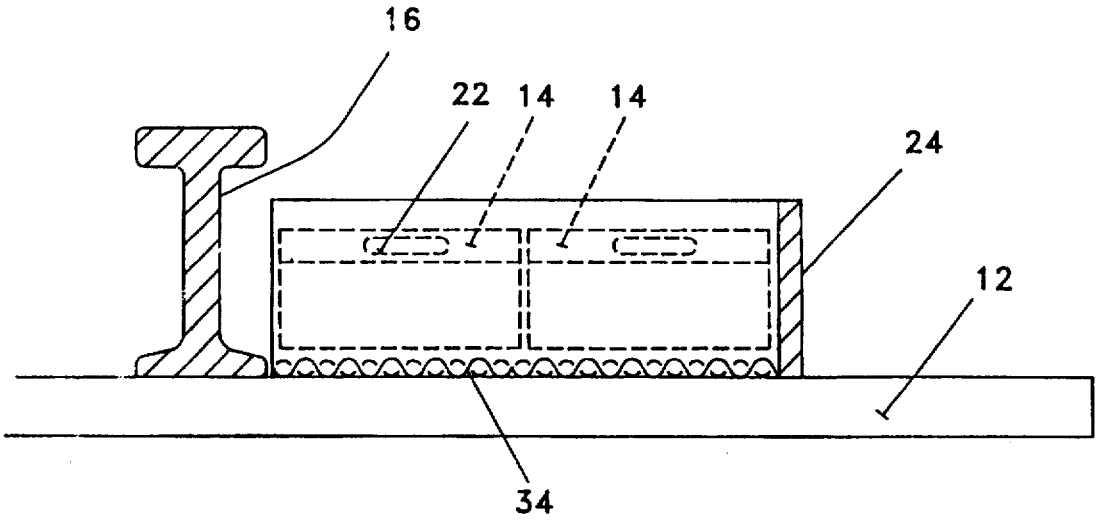
FIG. 12 is a vertical sectional view taken in direction of the arrows and along the plane of lines 12—12 in FIG. 1.
Figure 13:
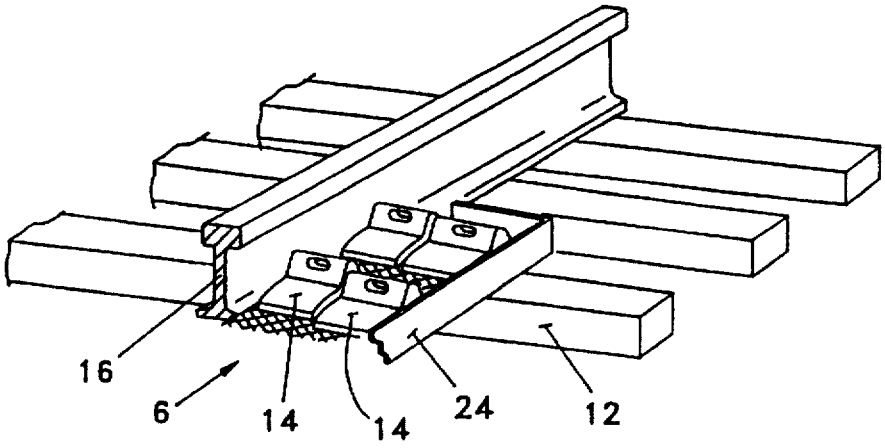
FIG. 13 is a partial perspective view of an embodiment of the track assembly having a pair of brake shoes disposed therein in an aligned position.

In usual placement of the rack assembly 10 in a rail yard, one side of a rail 16 of a railroad track 6 forms a fourth side of the rack assembly 10 for containing a plurality of brake shoe members 14 therein. It is well known that a typical railroad track 6 comprises a plurality of railroad tie members 12 for supporting a pair of generally parallel rail members 16—16. The rack assembly 10 is abutted against the outer side of one of the rail members 16 (see FIGS. 1 and 12) such that the combination of the rail member 16 of the railroad track 6 and the rack assembly 10 form a container suitable for containing the plurality of brake shoe members 14. As shown in FIG. 2 and FIG. 9, the side walls 20-22 have respective ends 50-52 abutted against a longitudinal side 54 of one of the rail members 16. At least one staple member 18 (see FIG. 9) is passed through the grid member 32 and secured to the railroad tie member 12 such that a portion of the grid member 32 is engaged by the staple member 18 for securing the rack assembly 10 to the railroad tie 12. For every railroad tie 12 that is situated below the grid member 32, a staple member 18 is utilized to secure the grid 32 of the rack assembly 10 thereto. It is understood that any suitable means of securing the rack assembly 10 to the railroad ties 12—12—12 is encompassed by the spirit and scope of the present invention, and that other means, such as nails, bolts, and the like, are included in the present invention.

In one preferred embodiment, as seen in FIG. 9, the rack assembly 10 is adapted for receiving the plurality of the brake shoe members 14 such that the plurality of brake shoes 14 is contained in a contiguous relationship that is characterized by a single row of the brake shoes being held within the rack (i.e. the shoes 14—14 on each end of the row or plurality of shoes 14 abut respective side walls 20-22, and all of the shoes 14 abut the end wall 24 and the longitudinal side 54 of rail member 16, against which the side walls 20-22 are also abutted). It is understood that any suitable rack assembly 10 for containing a the plurality of brake shoes 14 is understood in the spirit and scope of the present invention.

Figure 8:
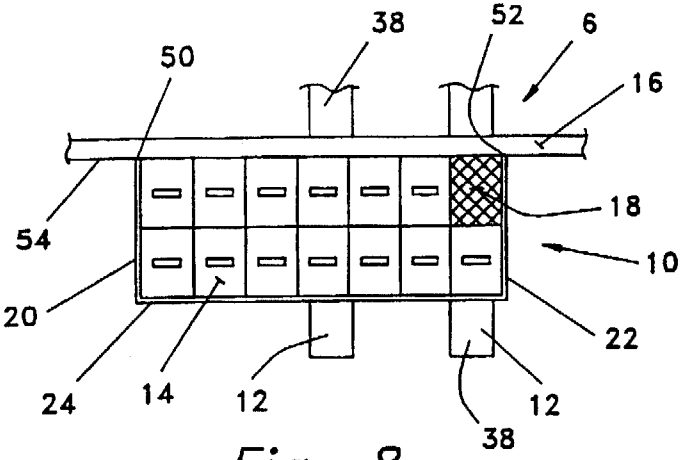
FIG. 8 is a top plan view of an alternative embodiment of the rack assembly in combination with the railroad track having new and used brake shoes contained thereby in two rows.
Figure 10:
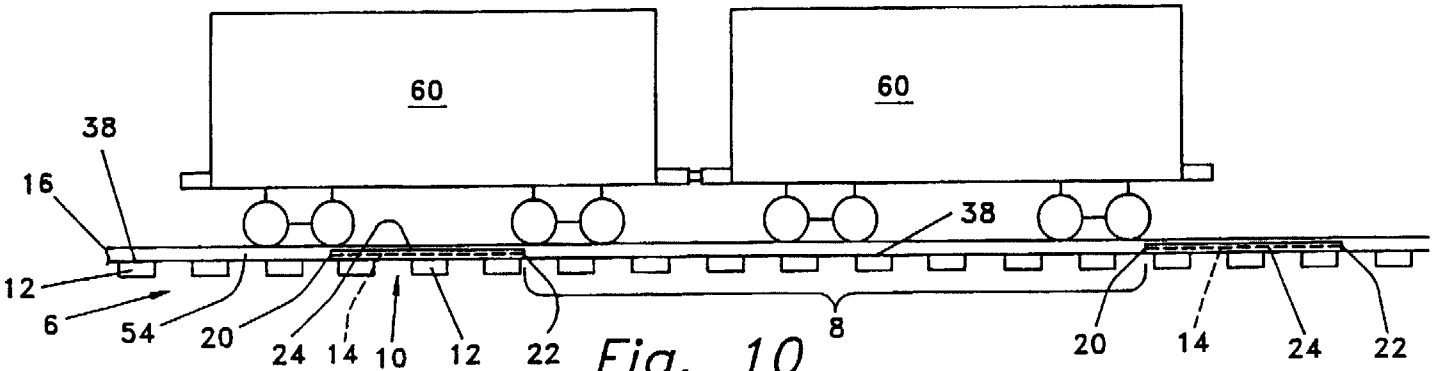
FIG. 10 is a side elevational view of a plurality of the rack assemblies of FIG. 1 secured to a plurality of railroad ties and abutted against one side of a one rail of a railroad track.
Figure 11:
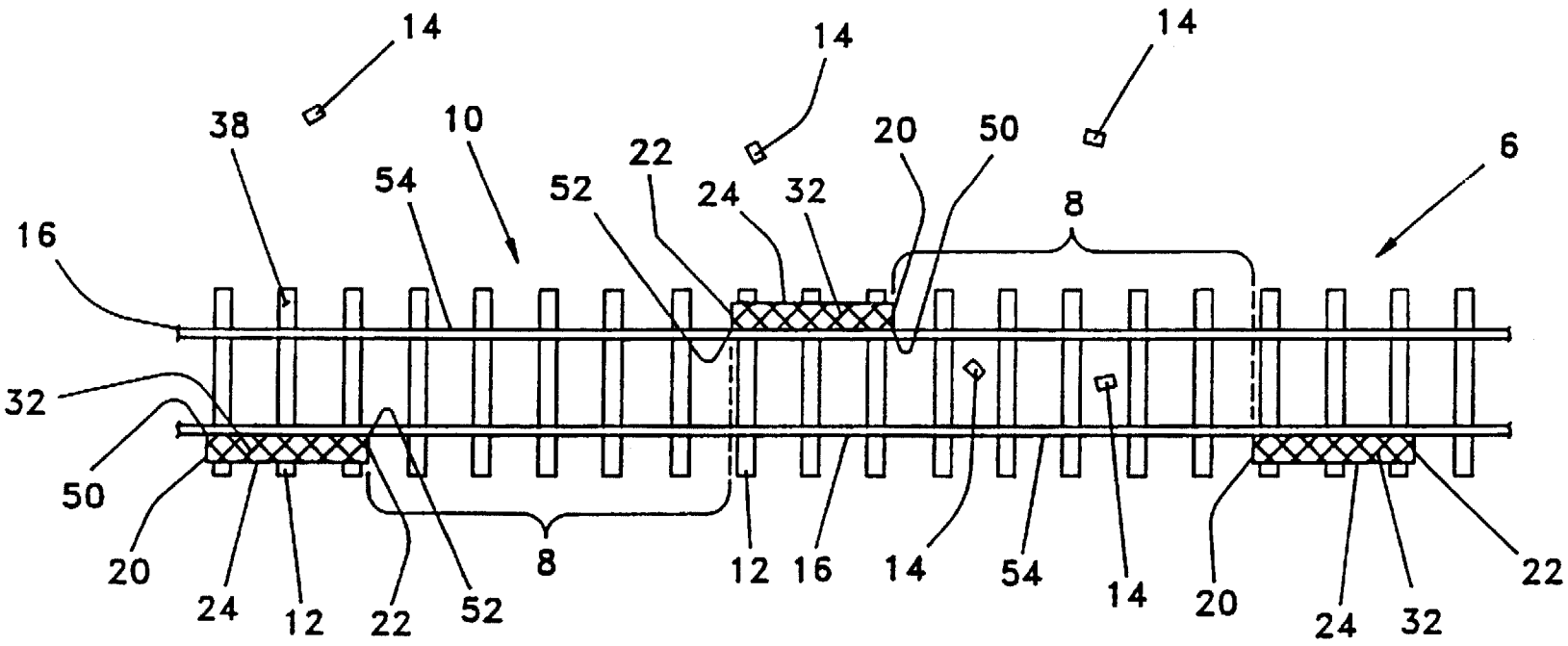
FIG. 11 is a top plan view of a plurality of the rack assemblies of FIG. 1 secured to a railroad track.

Referring now to the drawings for operation and use of the present invention, there is seen in FIG. 1 the rack assembly which is secured to at least one, preferably to three railroad ties 12—12—12. A plurality of new brake shoes 14 is disposed in the rack assembly 10 so as to be contained thereby. As previously indicated, the rack assembly 10 may be embodied as shown in FIG. 9 so as to hold a single row of brake shoes 14, or as shown in FIG. 8 so as to hold a pair of rows of brake shoes 14, and it is understood that the rack assembly 10 may be arranged to hold any number of rows of brake shoes 14, and any number of layers of brake shoes 14 without departing from the spirit and scope of the present invention. The rack assembly 10 is provided and secured to the railroad ties 12 as indicated previously by passing a plurality of staples 18 through the mesh or grid member 32 such that a portion of the top edge of the grid 34 is engaged by the plurality of staples 18. The staples 18 are retained by or secured to the least one railroad tie member 12 of a railroad track 6 for fixedly coupling the rack assembly 10 thereto, although, as further previously indicated, usually and preferably three railroad tie members 12—12—12 are engaged by the staples 18 and the rack assembly 10. Another rack assembly 10 is secured to another group of railroad tie members 12—12—12 (see FIG. 10) such that a distance 8 of from bout 75 feet to about 200 feet is formed between the rack assemblies 10—10. More preferably, the distance 8 ranges from about 90 feet to about 160 feet, most preferably from about 100 feet to about 130 feet. A plurality of the rack assemblies 10 may thus be spacedly secured to the railroad track 6. As shown in FIG. 11, the rack assemblies 10 may further be alternatingly disposed on opposite sides of the railroad tracks 6 such that odd-numbered rack assemblies 10 are on the outside edge or longitudinal side 54 of one rail member 16 of the track 6 and even-numbered rack assemblies 10 are on the outside edge or longitudinal side 54 of the other rail member New brake shoes 14 are disposed in the rack assembly 10 and contained therein until needed. The new shoes 4 are removed from the rack assembly 10 and used (i.e. installed on a rail car in replacing old, worn shoes) to replace old, worn brake shoes 14 on a stopped railway car 60 (see FIG. 10). Typically, a train (i.e. an engine and at least one railway car 60) is stopped on the track 6 for service maintenance, which service includes changing the brake shoes (not shown in FIG. 10) of rail cars 60 which are in need of new shoes. The needed new shoes 4 are conveniently stored in the rack assemblies 10 along the track 6 and removed therefrom as needed to replace old shoe(s) 14 on the rail cars 60. The old shoe(s) 14 is then placed in the rack assembly 10 from which the new shoe(s) 14 was obtained.

Thus by the practice of the present invention, a method for reducing and/or eliminating accidents and/or injuries suffered due to tripping on or otherwise accidentally contacting haphazardly scattered used rail car brake shoes 14 is provided (as seen in FIG. 11). By utilizing the rack assembly(s) 10, used rail car brake shoes 14 are safely stored in a contained location for recycling or suitable disposal (see FIG. 9), instead of tossed about the rail yard or in between the rails 6—6 of the railroad track 6 (see FIG. 11).

Preferably, the rack assembly 10 is suited to hold from about 10 to about 20 brake shoes, more preferably from about 12 to about 18 brake shoes, most preferably from about 14 to 16 brake shoes. The rack assembly(s) 10 is replenished regularly with new shoes 14, and old shoes 14 are removed therefrom regularly for recycling, refurbishing, or the like.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for handling used brake shoes which are removed from a railway car on a railroad track comprising the steps of:

(a) providing a rack assembly comprising an end wall member secured to a first side wall member and secured to a second side wall member;

(b) securing said rack assembly to at least one of a plurality of railroad tie members supporting a pair of rail members such that said end wall member is generally parallel to one of said pair of rail members; and (c) removing at least one worn brake shoe from a railway car;

(d) disposing said at least one worn brake shoe in said rack assembly such that said worn brake shoe is contained within said first side wall, said second side wall, said end wall, and said one of said pair of rail members.

2. The method of claim 1 additionally comprising providing at least one new railway car brake shoe and disposing said at least one new railway car brake shoe in said rack assembly prior to said disposing step (d).

3. The method of claim 2 additionally comprising removing said at least one new railway car brake shoe from said rack assembly and fitting said at least one new railway car brake shoe to said railway car in place of said worn brake shoe.

4. The method of claim 3 additionally comprising providing a plurality of said rack assembly; securing said plurality of said rack assembly in a generally spaced relationship along said plurality of said railroad tie members such that a distance is defined between each of said plurality of said rack assembly.

5. A method for handling new railway car brake shoes comprising the steps of:

(a) providing a plurality of new railway car brake shoes;

(b) providing a railroad track having a pair of rail members secured to a plurality of railroad tie members;

(c) providing a rack assembly comprising an end wall member secured to a first side wall member and secured to a second side wall member;

(d) securing said rack assembly to at least one of said plurality of railroad tie members such that said end wall member is generally parallel to one of said pair of rail members;

(e) disposing said plurality of new railway car brake shoes in said rack assembly such that said new railway car brake shoes are contained by said first side wall member, said second side wall member, said end wall member, and said one of said pair of rail members.

6. The method of claim 5 additionally comprising providing a plurality of said rack assembly; securing said plurality of said rack assembly in a generally spaced relationship along said plurality of said railroad tie members such that a distance is defined between each of said plurality of said rack assembly and disposing a portion of said plurality of said new railcar brake shoes in each of said plurality of said rack assembly.

7. A method for preventing accidents in railway yards caused by accidental contact with stray railcar brake shoes comprising the steps of:

(a) providing a railway yard having a railroad track comprising a pair of rail members secured to a plurality of railroad tie members;

(b) providing a rack assembly comprising an end wall member secured to a first side wall member and secured to a second side wall member;

(c) securing said rack assembly to at least one of said plurality of railroad tie members such that said end wall member is generally parallel to one of the pair of rail members; and (d) disposing said stray railcar brake shoes in said rack assembly such that said stray railcar brake shoes are contained by said first side wall member, said second side wall member, said end wall member, and said one of said pair of rail members.

8. The method of claim 7 additionally comprising providing a plurality of said rack assembly; securing said plurality of said rack assembly in a generally spaced relationship along said plurality of said railroad tie members such that a distance is defined between each of said plurality of said rack assembly; and disposing a portion of said stray railcar brake shoes in each of said plurality of said rack assembly.

9. A rack assembly for retaining railcar brake shoes comprising an end wall secured to a first side wall and secured to a second side wall; said end wall and said first side wall and said second side wall being supported by at least one of a plurality of railroad ties supporting a pair of rail members such that said end wall member is generally parallel to one of said pair of rail members.

* * * * *